United States Patent [19]

Alberti

[11] 4,421,047

[45] Dec. 20, 1983

[54] UPPER FEED DOG DEVICE

[75] Inventor: Adriano Alberti, Pavia, Italy

[73] Assignee: Rockwell International Corporation, Pittsburgh, Pa.

[21] Appl. No.: 319,858

[22] Filed: Nov. 9, 1981

[30] Foreign Application Priority Data

Jun. 2, 1981 [IT] Italy ..... 22098 A/81

[51] Int. Cl.[3] ..... D05B 27/06

[52] U.S. Cl. ..... 112/311

[58] Field of Search ..... 112/311, 320, 323, 314

[56] References Cited

U.S. PATENT DOCUMENTS 4,199,995 4/1980 Murakami ..... 112/323 X
4,285,294 8/1981 Aida ..... 112/311
4,295,434 10/1981 Hsiao ..... 112/323 X

FOREIGN PATENT DOCUMENTS 2063938 6/1981 United Kingdom ..... 112/323

*Primary Examiner*—Werner H. Schroeder
*Assistant Examiner*—Andrew M. Falik

[57] ABSTRACT

An upper feed dog for sewing machines carried by an actuating arm pivotably mounted on a support fixed to the upper surface of the main feed bar that carries the main lower feed dog. A control arm has one end pivotably connected to the same pivot as the actuating arm and its opposite end is pivotably connected to a guide block carried in one end of a double-forked lever. The opposite end of this lever is operatively associated with an oscillatably driven shaft, the motion of which is transmitted to the actuating arm by a coil spring interposed between the latter arm and the control arm and is effective so as to cause pressure of the upper feed dog on a workpiece to be progressive and prevent direct impact between the control arm and the actuating arm, whereby the operating noise level of the machine operating at high speed is greatly reduced.

6 Claims, 3 Drawing Figures

UPPER FEED DOG DEVICE

BACKGROUND OF THE INVENTION

The present invention pertains to an upper feed dog device for sewing machines which permits a machine to operate at high speed that is comparable to machines which do not utilize upper feed dogs, and with the drive elements for actuating the upper feed dog being arranged so that their operating noise is held at a substantially low level.

Sewing machines provided with upper feed dog devices are well known to those conversant in the sewing art and a number of U.S. patents show and describe such machines. For a detailed description of the teachings of such machines, attention is hereby drawn to U.S. Pat. Nos. 3,530,809 and 4,166,422. The known sewing machines equipped with upper feed dog devices are subject to certain disadvantages such as direct contact between the arm supporting the upper feed dog and the drive elements for actuating the same, resulting in the necessity of operating the machines at reduced speeds in order to maintain the operating noise at an acceptable level. Additionally, other known machines utilize spring means acting directly on the arm which carries the upper feed dog and such springs must be exceptionally long to properly perform their intended function. This creates a bulky, unattractive structure projecting beyond the normal profile of the machine and, being in operative association with the machine's work area, the added elements interfere with the ease of operating the machine.

The device according to the present invention eliminates the disadvantages of the known upper feed dog devices utilized in sewing machines of the prior art by providing such a device wherein the upper feed dog pressure is applied progressively to a workpiece and will increase in direct proportion to any variation in an increase in the thickness thereof. Additionally, machines to which the invention is applied are capable of operating at substantially greater speeds for there is no direct connection or contact between the feed dog carrier arm and the control arm for effecting its actuation.

SUMMARY OF THE INVENTION

The present invention utilizes a control arm, one end of which is mounted on a pivot aligned with the pivot for supporting an upper feed dog carrier arm. The opposite end of the control arm is pivotably attached to a guide block slidably mounted in one end of a double-forked lever that is pivotably mounted intermediate its ends. The opposite end of the double-forked lever is also provided with a guide block slidably carried therein that is operatively connected to an oscillatably driven shaft and, by means of a coil spring interposed between the upper dog carrier arm and the control arm, the movement of the double-forked lever is transmitted to said upper dog carrier arm.

It is a general object of the invention to provide an improved upper feed dog device for sewing machines that can be operated at higher speeds than known machines of the prior art.

A further object is that of substantially reducing the operating noise of the elements for effecting actuation of the upper feed dog.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
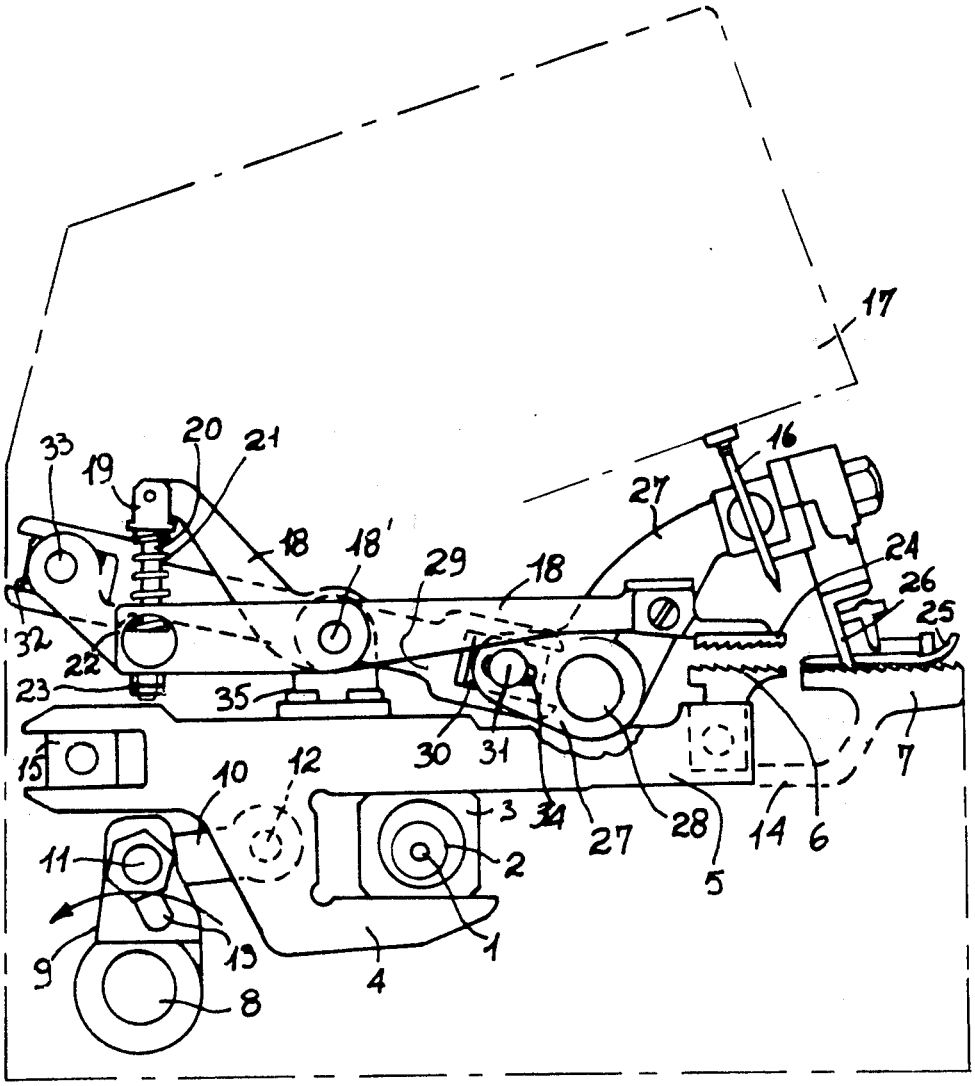
FIG. 1 is a view in side elevation of a portion of a sewing machine showing the device according to the invention applied thereto.
Figure 2:
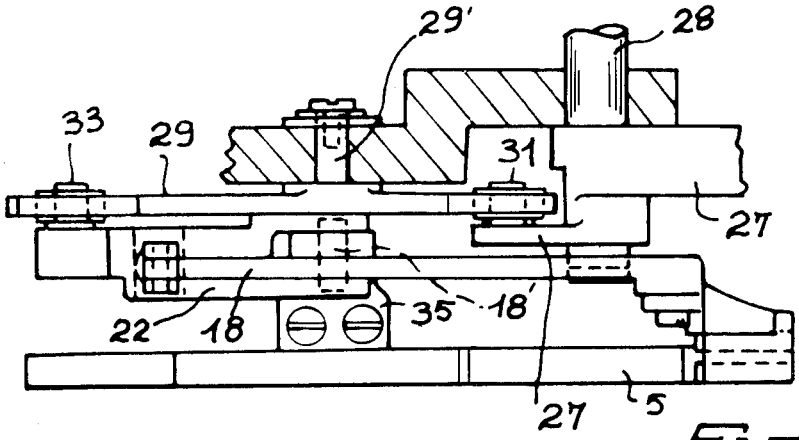
FIG. 2 is a plan view of the device shown in FIG. 1.
Figure 3:
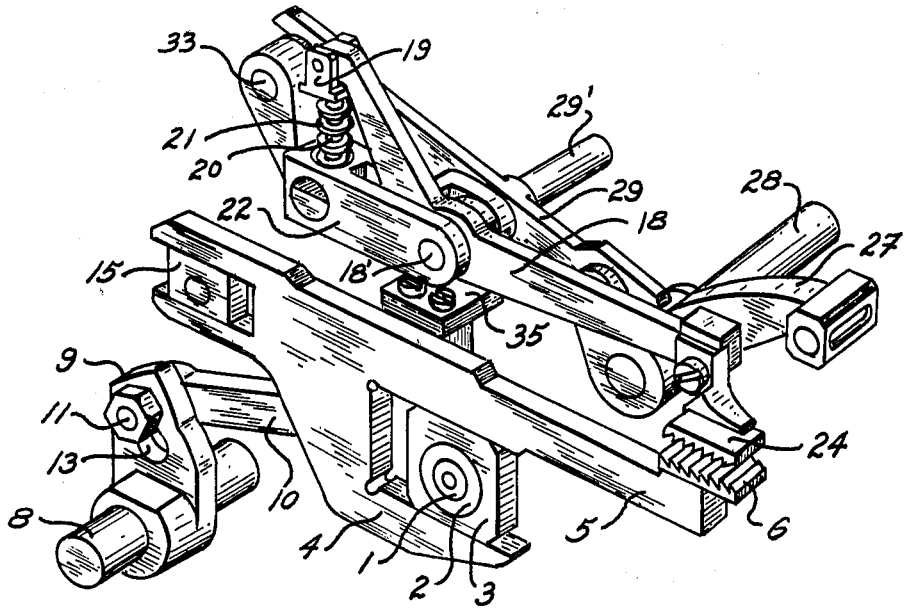
FIG. 3 is a perspective view of the device shown in FIGS. 1 and 2.

Referring to FIG. 1 of the drawings wherein only as much of a sewing machine structure is depicted as is necessary for a complete understanding of the invention, there is shown the machine's main shaft that is identified by numeral 1. Shaft 1 is rotatably driven and a cam 2 is fixed thereon that is operatively associated with a guide block 3. The guide block 3 is located within the forked portion 4 of the main feed bar 5, and rotation of cam 2 with shaft 1 is effective in providing the vertical movement of the main and differential feed dogs 6 and 7, respectively.

The required horizontal movements of the feed dogs 6 and 7 in combination with their vertical movements are accomplished by an oscillatably driven shaft 8 having an upwardly directed arm 9 fixed thereon which is connected to the main feed bar 5 by means of a link member 10. This link member 10 is pivotably connected at one end to the arm 9 as at 11, and on the opposite end to the main feed bar 5 as at 12. Thus, the main lower feed dog 6 carried by the main feed bar 5 receives from shafts 1 and 8 the combination of motions for causing ascent and feed and, being properly phased, determines the quadrilateral motion of this feed dog. The horizontal path of the feed dog 6 can be selectively varied by adjusting the position of that end of the link member 10 where it is connected by means of a slot 13 to the arm 9.

The differential feed dog 7 receives its ascent motion from cam 2 by means of the guide block 3 being in contact with the underside of the main feed bar 5 and an adjacent bar 14 which flanks said bar 5. The means for horizontal motion of the feed dog 7 (not shown) is similar to that for feed dog 6 in that it is initiated by the oscillating movement of the shaft 8. During its horizontal movement, the main feed bar 5 is caused to slide along the horizontal surfaces of the guide blocks 3 and 15.

The machine's needle is depicted by numeral 16 and is reciprocated in a well known manner (not shown) by means contained within the housing 17 of the machine.

The upper feed dog carrier arm is identified by numeral 18 and is mounted on a pivot 18'. One end of this arm 18 extends in an upwardly direction and has a cap member 19 pivotably attached thereto. A pin 20 depends from the cap 19 and has a coil spring 21 assembled thereon which is interposed between said cap 19 and the upper surface of a control arm 22 which is pivotably mounted on the same pivot 18' as the upper feed dog carrier arm 18.

The lower portion of the pin 20 extends through an opening in the control arm 22 and the lower end thereof is threaded to receive a lock nut 23 which serves as a means for regulating an upper feed dog 24. This upper feed dog 24 is mounted on that end of the carrier arm 18 opposite the cap member 19 and, by means of lock nut 23, can be adjusted to accommodate a variation in thickness and type of workpiece being sewn. Although not shown, it is well known that the position of a workpiece when adjacent the machine's needle 16 is between the main feed dog 6 and the upper feed dog 24, and before reaching the needle would be located between the differential feed dog 7 and the machine's presser foot 25.

A workpiece prior to being acted upon by the needle 16 is trimmed along one side thereof by a trimming blade 26 assembled on an arm 27 which is fixed on and for movement with an oscillatably driven shaft 28.

Arm 27 serves as a control element that provides motion to a double-forked lever 29 which is mounted on a pivot 29' that is in alignment with pivot 18' at the start of each feed cycle of the main and upper feed dogs 6 and 24, respectively.

As shown in FIG. 1, the right-hand forked end of lever 29 has a guide block 30 assembled therein which is operatively connected to arm 27 by means of a pin 31. Thus, lever 29 being caused to oscillate on pivot 29', as a result of movement of arm 27, transmits its movement to the control arm 22 by means of a guide block 32 in the left-hand forked end thereof that is operatively connected to said control arm 22 by means of a pin 33.

To adjust the upper feed dog 24, the pin 31 which operatively connects lever 29 with arm 27 is selectively positionable within the limits of a slot 34 provided in said arm 27. This adjustment feature provides a means for varying the linkage between the end of the lever 29 and the guide block 30 so as to permit controlled adjustment of the oscillation amplitude of said lever 29 and thus the upper feed dog 24. The pivot 18' forms part of a support 35 that is fixed on and movable with the main feed bar 5. Although not shown, the main shaft 1 is operatively connected to other parts of the machine such as the arm 9 which, by means of a link member 10, provides the horizontal feed movements to the main feed bar 5. Additionally, the arm 27 being operatively connected to the oscillatably driven shaft 28 provides the required reciprocating movement for the trimming blade 26 as well as the movements through which the upper feed dog 24 is caused to travel.

It should be understood that the coil spring 21 interposed between the control arm 22 and the upper feed dog carrier arm 18 transmits the feed dog loading necessary for progressive pressing on a workpiece in direct proportion to a variation in the thickness of a workpiece, and thus serves as a shock absorbing element taking up the oscillation differences between the lever 29 and said upper feed dog carrier arm 18 once contact is made with the workpiece. When the lever 29 reverses its direction of movement about the pivot 29', the coil spring 21 is effective in first eliminating the oscillation differences and then governs the ascent of the upper feed dog as the arms 18 and 22 are functioning as a single element.

The linkage for actuation of the upper feed dog being spring biased is effective in causing what is considered a very short distance of travel of the control arm 22, and the difference between the travel of this arm and that of the upper feed dog carrier arm 18 is also considered to be a comparatively short distance.

This linkage arrangement greatly reduces the operating noise level by the elimination of a direct and positive connection between the upper feed dog carrier arm 18 and the control arm 22. The pin 20 which supports the spring 21 is on the opposite side of the pivot 18' relative to the position of the upper feed dog 24 and, being on the shorter portion of this arm, its amount of movement is substantially less than the end carrying the upper feed dog. Thus, in order to provide the required ascent of the upper feed dog, it is only necessary that the deflection value of the spring 21 under compression be very moderate. The spring is lighter and of low inertia because of the small difference between the distances of travel described above.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An upper feed dog device for sewing machines of the type having a needle, pressure foot, trimming blade and a main feed bar for supporting and moving a main lower feed dog through a rectangular pathway and an oscillatably driven shaft for controlling the machine's trimming blade and presser foot, said upper feed dog device comprising:

(a) a support (35) fixed on and for movement with the main feed bar;

(b) an upper feed dog carrier arm (18) piovotably mounted on said support (35) having:

(i) an upper feed dog (24) fixed on one end thereof;

(c) a control arm (22) pivotably mounted on said support (35) adjacent said upper feed dog carrier arm (18);

(d) means connected to one end of said control arm (22) for oscillating the same on said support (35); and (e) means for transmitting the oscillating movement of said control arm (22) to said upper feed dog carrier arm (18) for actuating said upper feed dog (24).

2. The upper feed dog device according to claim 1 wherein said oscillating means defines a double-forked lever (29) pivotably mounted intermediate its ends, and means operatively connecting one end thereof to the oscillatably driven shaft.

3. The upper feed dog device according to claim 2 wherein the end of said control arm (22) is pivotably connected to a guide block (32) slidably mounted in one of the ends of said double-forked lever (29).

4. The upper feed dog device according to claim 3 wherein said means operatively connecting one end of said double-forked lever (29) to the oscillatably driven shaft includes:

(a) an arm (27) fixed on and for movement with the oscillatably driven shaft; and (b) one end of said arm (27) being pivotably connected to a guide block 30 slidably mounted in the opposite end of said double-forked lever (29).

5. The upper feed dog device according to claim 1 wherein said transmitting means includes:

(a) a pin (20) pivotably attached to and depending from one end of said upper feed dog carrier arm (18);

(b) a coil spring (21) assembled on said pin (20) having one end in operative engagement with said control arm (22) and the other end with said upper feed dog carrier arm (18).

6. The upper feed dog device according to claim 5 wherein said pin (20) is threaded for receiving a lock nut (23) for selectively regulating the biasing force which said coil spring (21) transmits to said upper feed dog (24).

* * * * *